US006935510B2

(12) United States Patent
Nied

(10) Patent No.: US 6,935,510 B2
(45) Date of Patent: Aug. 30, 2005

(54) AIR SEPARATOR

(76) Inventor: Roland Nied, Raiffeisen-Strasse 10, 86486 Bonstetten (DE)

( * ) Notice: Subject to any disclaimer, the term of this patent is extended or adjusted under 35 U.S.C. 154(b) by 265 days.

(21) Appl. No.: 10/363,219

(22) PCT Filed: Sep. 7, 2001

(86) PCT No.: PCT/EP01/10357

§ 371 (c)(1),
(2), (4) Date: Apr. 3, 2003

(87) PCT Pub. No.: WO02/26405

PCT Pub. Date: Apr. 4, 2002

(65) Prior Publication Data

US 2004/0035765 A1 Feb. 26, 2004

(30) Foreign Application Priority Data

Sep. 7, 2000 (DE) ..... 100 44 104

(51) Int. Cl.[7] ..... B07B 11/01

(52) U.S. Cl. ..... 209/139.1; 209/139.2; 209/133; 209/140

(58) Field of Search ..... 209/133, 139.1, 209/139.2, 140, 141

(56) References Cited

U.S. PATENT DOCUMENTS 2,753,996 A * 7/1956 Kaiser ..... 209/139.1
2,779,467 A * 1/1957 Lykken ..... 209/139.2
3,433,422 A * 3/1969 Guenther ..... 241/61
3,960,714 A * 6/1976 Strauss ..... 209/139.2
5,158,182 A * 10/1992 Fischer-Helwig et al. .. 209/135
5,957,300 A * 9/1999 Nardi et al. ..... 209/143
6,260,708 B1 * 7/2001 Adam et al. ..... 209/139.2
6,276,543 B1 * 8/2001 German et al. ..... 215/252
6,739,456 B2 * 5/2004 Svoronos et al. ..... 209/725
6,776,291 B1 * 8/2004 Tirado et al. ..... 209/154

* cited by examiner

*Primary Examiner*—Donald P. Walsh
*Assistant Examiner*—Jonathan R. Miller
(74) *Attorney, Agent, or Firm*—Levine & Mandelbaum

(57) ABSTRACT

The invention relates to an air separator for sifting material suspended in a flow of gas having course material and fine material by using a sifting wheel which rotates in a sifting chamber and which has blades fixed on the external periphery thereof. The blade channels are cross-flown radially from the outside by gas containing the suspended fine particles. The oversized particles are rejected before reaching he internal end of the blade canal. The flow of fine particles is guided through the blade channels in a forced manner in a plurality of consecutive layers in the direction of the axis of rotation. The arrangement in layers of the flow of fine particles after it leaves the blade channels remains in place until it leaves the sifting chamber.

6 Claims, 3 Drawing Sheets

AIR SEPARATOR

BACKGROUND OF THE INVENTION

The present invention pertains to the separation of material to be separated, which is suspended in a gas flow, in such a form that a crude gas flow is forced to enter the blade channels between the blades of a separator wheel rotating in a separation space against the action of the centrifugal force, in which channels coarser separated material is deflected radially toward the outside under the effect of the centrifugal force, while finer separated material is carried by the gas flow radially inwardly, and this gas flow containing the fines is removed from the separator wheel in the center of the separator wheel for further processing. This air separation is known state of the art and is, e.g., already state of the art according to EP 0 641 609 B1.

It is also a general state of the art that the cross section of a fluid flow is divided into a plurality of partial flows in order to affect the partial flows independently from one another in order to make uniform an overall flow that is nonuniform over its cross section due to unintended but unavoidable effects, i.e., to compensate the effects, or, in the contrary case, to make different an overall flow that is uniform over its entire cross section from the very beginning in a specific manner in different cross-sectional areas.

This principle described last was applied in DE-OS 36 22 413 in air separation in such a form that to favorably affect the separation effect of the separator and to save energy, the separating air to be fed to the separator wheel is divided by partitions into individual partial flows and each partial flow can be affected independently from the other partial flows in terms of volume and/or flow velocity. Corresponding to the number of the partial flows separated from each other, the blades of the separator wheel are divided in terms of their length. It is considered to be essential in this prior-art solution concerning the present invention that even though the separating air flowing to the separator wheel is divided by partitions in the incoming flow channel and the fluid mixture consisting of separating air and crude gas flow (air with particles suspended in it) by dividing the separating blades in terms of their height into partial flows, this forced division into partial flows is eliminated on the way from the outlet from the separator wheel to the fines outlet of the separator, and the composition of the flow of fines is more or less random over its entire cross section, and a forced effect is not provided, which in turn means that the separation limit is affected favorably only insufficiently.

SUMMARY OF THE INVENTION

This is where the present invention begins, by showing how the separation limit can be favorably affected from the beginning of the entry of the material to be separated into the separator until the material leaves the separator, how a flow of fines that is uniform over its entire cross section is subjected to further processing or how a flow of fines that is intentionally stratified over its entire cross section is sent for further processing, and how, in particular, coarse product is separated in a plurality of steps, so that a maximum of fines-gas flow freed from coarse material to the maximum extent possible is removed from the air separator.

The present invention consequently proposes the maintenance of the flow stratification achieved by the division of the blade channels even after the blade channels have been left in order to avoid that energy is lost due to the merging of the partial flows into the overall flow after leaving the flow channels, as this energy would have to be compensated because of the design of the plant by providing a larger amount of initial energy, which would lead to an uncontrolled and consequently random particle distribution over the entire cross section of the flow of fines from the viewpoint of the desired optimal separation. In particular, the present invention creates the possibility of separating coarse material in a plurality of consecutive steps, which are strictly separated from one another until the transition from one step to the next step, so that coarse material is separated at the end in the best possible manner and the product leaving the separator is freed from coarse material in the best possible manner.

The present invention makes possible an air separation in which less energy needs to be used than in the state of the art, but this is only one of the advantages of the present invention, because a general goal that is desirable for the person skilled in the art in flow mechanics for many different reasons is to avoid superfluous vortex formation. A particle distribution that is more uniform on the whole over the entire cross section is achieved with the present invention, which results in a favorable effect on the separation effect. Finally, optimal separation is achieved between coarse material and fines.

Consequently, the present invention proposes an air separator according to the patent claims, in which optimal separation of the coarse material is guaranteed and the other problems mentioned above are also solved optimally.

DESCRIPTION OF THE DRAWINGS

Air separators and processes to be carried out with same will be described below in preferred embodiments on the basis of the drawings; in the drawings.

DESCRIPTION OF THE PREFERRED EMBODIMENT

Figure 3:
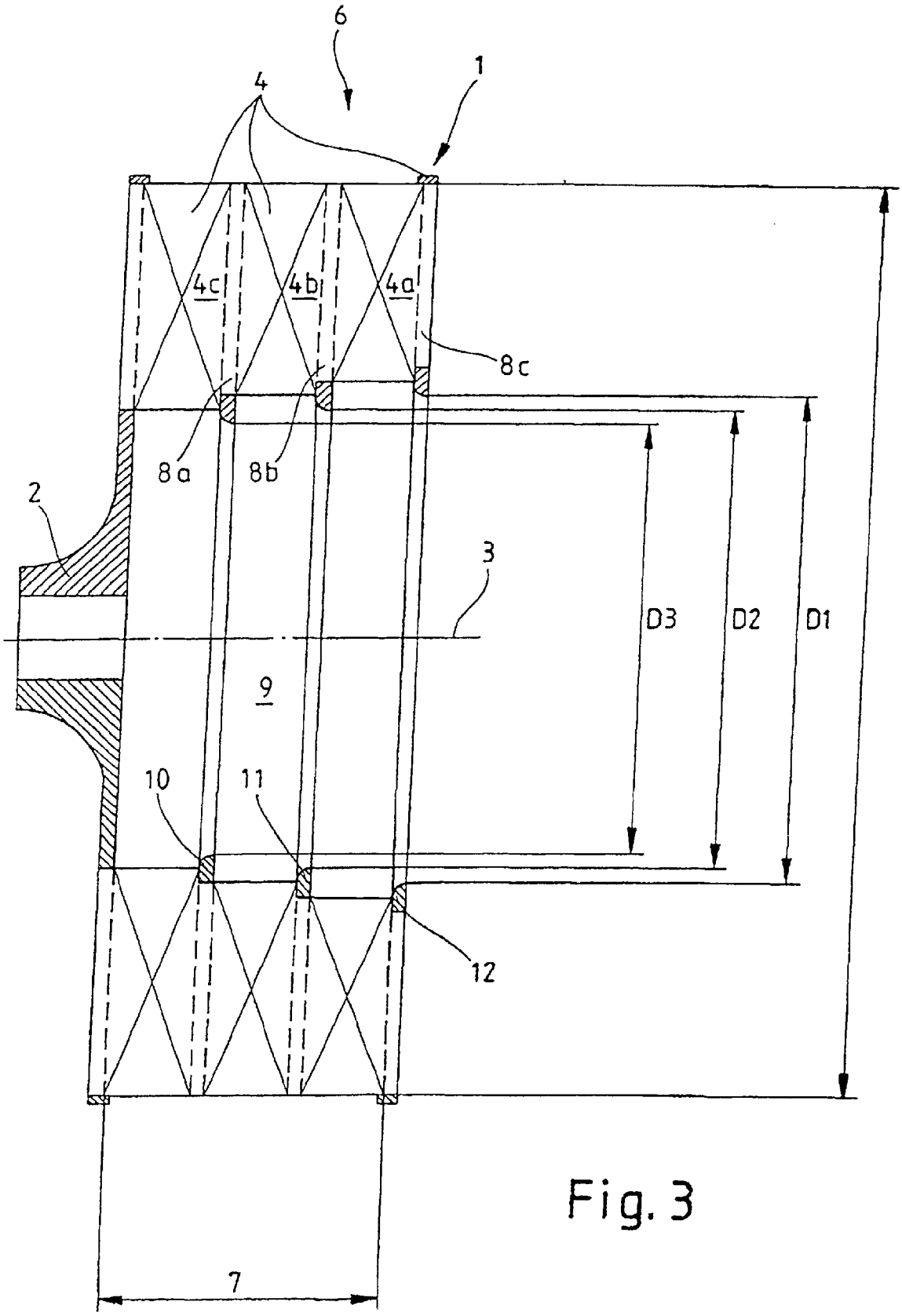
FIG. 3 shows a separator wheel according to the present invention as a cross section.

FIG. 3 shows a central longitudinal section of a rotor or separator wheel 1 for an air separator, into the hub 2 of which rotating forces are to be introduced such that the entire rotor 1 is rotatable around its central longitudinal axis 3. In the outer area, blades 4 are associated with the hub, the said blades being distributed uniformly on the outer circumference of the hub such that a blade channel, which is intended to be flown through radially from the outside to the inside (direction of arrow 6), is formed between two blades each following each other in the circumferential direction. The fluid flowing through the blade channels from the outside to the inside is a gas, preferably air, in which solid particles of various weights are suspended, the different weights being preferably manifested by different particle sizes. During the air separation, particles down to a defined, preferably very small grain size are entrained by the flowing gas against the action of the centrifugal force and they leave the blade channels together with the flowing gas at the inner ends of the blade channels. Particles of a higher weight or larger particle size are, by contrast, either already prevented by the centrifugal force from entering the blade channels, or they are delivered again to the outside after entering the blade channels. The particles entrained by the separating gas are below the "separation limit," which is set as accurately as possible and shall be maintained obligatorily, and the deflected particles are above the "separation limit." The rejected coarse material is sent first once again into a mill before it is fed again to the separator wheel. This process is optionally repeated several times until the separated material comes below the separation limit and is entrained by the separating gas against the action of the centrifugal force. The fines suspended in the separating gas are deflected with, the separating gas from the radial direction of flow into the axial direction of flow after leaving the blade channels, and they leave the separator through an outlet opening (not shown in FIG. 3) located opposite the hub in order to be subjected to further treatment, which consists, in general, first of the separation of the separating air and the fines, e.g., in a filter.

The design and the mode of operation of the separator wheel are conventional up to this point.

In a manner that is likewise known but generally not usual, the blades 4 are divided in their overall height 7 by two ring disks 8*a,* 8*b,* which divide the total suspension flow (fluid with solid particles suspended in it) into a plurality of partial suspension flows—into three partial suspension flows in the embodiment being shown—together with the hub 2 and a discharge-side blade end 8*c,* in order to affect, e.g., each partial flow independently from the other partial flows flowing through the separator wheel, but possibly even under the consideration that a total flow that is more uniform over the total cross section can already be obtained due to the division alone. However, the effect achieved is abolished especially in the latter case when the partial flows leave the blade channels in the same manner and the partial flows mix immediately after leaving the flow channels. Even the swirling associated herewith is undesirable, because it means losses of energy, which must be compensated by using a larger amount of energy. However, there also is, above all, an uncontrolled distribution of the fines over the entire cross section of the fluid flow, which means an impairment of the unambiguous definition and maintenance of the separation limit. The stratification of the fines suspended in the separating air is therefore maintained according to the present invention in the separator wheel space 9 adjoining the blade channels and ending in the fines outlet by the division of the separator wheel blades according to their height.

The separator wheel according to the present invention, which is shown in FIG. 3, is characterized for this purpose in that the diameters D1, D2, D3 at the inner edges of the blade decrease in a stepwise manner from the fines outlet opening (which is not shown, but is to be assumed to be located to the right of the view) toward the hub 2, i.e., the diameter D1 is greater than the diameters D2, D3, and the diameter D2 is in turn greater than the diameter D3. As a result, the fluid flow flowing out of the blade channels between the blade sections 4*b* in a cylindrical form comes to lie over the fluid flow flowing out of the blade channels between the blade sections 4*a* in a cylindrical form, and the fluid flow flowing out of the blade channels between the blade sections 4*c* in a cylindrical form comes to lie over the fluid flow flowing out of the blade channels between the blade sections 4*b* in a cylindrical form, without mixing taking place to an essential extent between the individual fluid flows.

To improve the effect, suction diaphragms 10, 11, 12, whose diameters likewise decrease from the suction opening toward the hub 2 like those of the inner edges of the partial blades 4*a,* 4*b,* 4*c,* are attached to the inner edges of the ring disks 8*a*, 8*b* as well as of the blade end 8*c*. The diaphragms 10, 11, 12 form rounded end areas, which facilitate the deflection of the flow from the radial direction into the axial direction in a trouble-free manner and facilitate the maintenance of the stratifications, which was mentioned several times.

Figure 1:
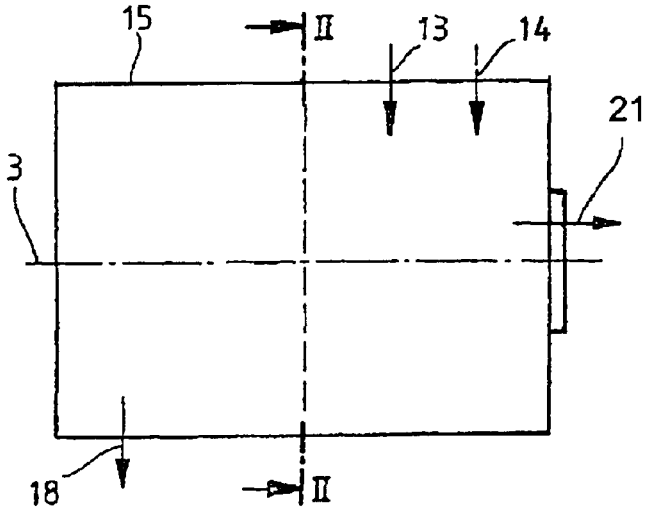
FIG. 1 shows a view of a separator housing used in the present invention at right angles to its longitudinal axis, which is at the same time the axis of rotation of the separator wheel arranged in the separator housing (direction of view A in FIG. 2)

The principle of this air separator, in which a separator wheel 1 according to FIG. 3 is used, is first explained by FIG. 1. The inlet 13 for the material to be separated and the inlet 14 for the separating air are associated with the separator housing 15 one after another in a radial plane, while the outlet 18 for the coarse material is arranged in another radial plane offset in the direction of the axis 3, directed radially opposite the inlet 14 for the separating air and the inlet 13 for the material to be separated.

Figure 2:
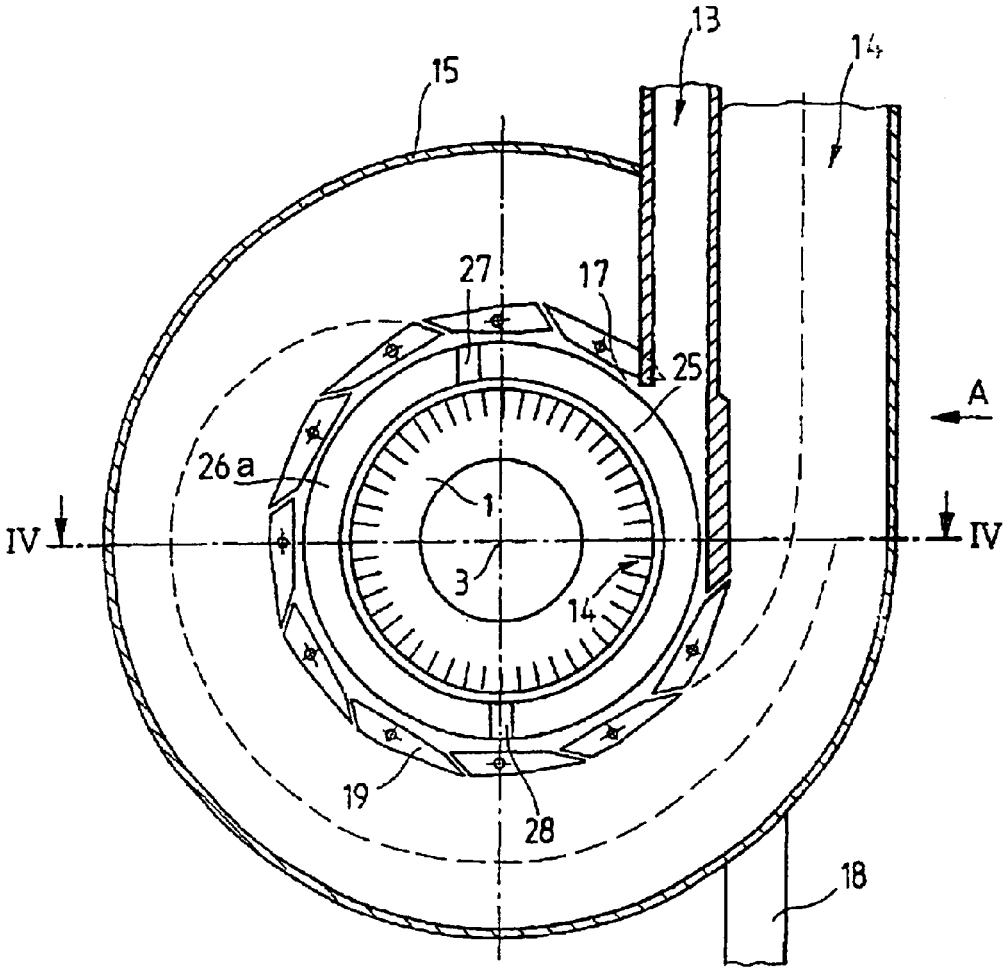
FIG. 2 shows an air separator of the design according to the present invention as a section along line II—II in FIG. 1.

The separation chamber 17 is enclosed by a stationary vane ring 19 within the separator housing 15, which is helical in the view in the direction of the longitudinal axis 3 (FIG. 2).

A separator wheel 1, which is designed according to FIG. 3, is arranged in the separation chamber 17 enclosed by the vane ring 19, again concentrically to the separator axis 3. The annular space between the outer circle of the separator wheel 1 and the inner circle of the vane ring 19 is relatively narrow, because no separation is to take place in it. The width of the annular space between the separator wheel and the vane ring is selected to be only as great as is necessary with respect to the ordered transfer of the coarse material consisting of material to be separated and separating air—the transfer of the latter from the vane ring—into the separator wheel 1.

The inlet 13 for the material to be separated opens tangentially into the separation chamber in the area of the annular space between the vane ring 19 and the separator wheel 1. The inlet 14 for the separating air opens tangentially into the annular space between the vane ring 19 and the housing 15, which is helical in the view in FIG. 2. The inlet 13 for the material to be separated and the inlet 14 for the separating air are pipes arranged in parallel to one another. The outlet 18 for the coarse material is a pipe, which is located opposite the inlet 14 for the separating air and the inlet 13 for the material to be separated in the view in FIG. 2, i.e., it is directed downwardly, and the two inlets 13, 14, on the one hand, and the outlet 16 for the coarse material, on the other hand, are offset in relation to one another in the direction of the longitudinal axis 3 of the separator or the axis of rotation of the separator wheel 1 by at least one turn of the helix, i.e., the housing 15 is a helical housing, which appears especially from the view in FIG. 1.

The separating air flows through the flow channels between the guide vanes of the vane ring 19 from the outside to the inside.

The guide vanes lie on a helical contour predetermined by the housing and are mounted rotatably in the housing 15 such that both the angle at which the separating gas flows in and the gap width through which the flow takes place between the blades can be varied.

The vane ring 19 is used at most for a comparatively slight preseparation, but above all for the intense dispersion and disagglomeration of the material to be separated. The separation proper takes place with good efficiency in the separator wheel.

The fines finally leave the separator via the fines outlet 21. Scattered material, which circulates close to the vane ring 19, is preferably removed from the separation space via the discharge 18 for coarse material. As a consequence of the offset of the inlet 13 for the material to be separated and the inlet 14 for the separating air, on the one hand, and the outlet 18 for coarse and scattered material, on the other hand, in the axial direction of the housing 15, the coarse material and possibly scattered material reach the area of the coarse material outlet 18 along the inner side of the housing wall, without special additional built-in elements, such as a baffle plate or a discharge screw being necessary.

Circular arc-shaped diaphragms 25, 26, which divide the separation space into a plurality of sections, by which the charge is separated from the fines in helical movements, not continuously but stepwise, and leaves the separation space as coarse material, are arranged according to the present invention in the annular space between the separator wheel 1 and the vane ring 19.

The circular arc-shaped segments 25, 26 are aligned with the suction diaphragms 10 through 12 of the separator wheel 1 arranged in a stepped pattern. They form an angle of at least 180□ such that they overlap each other at the ends associated with one another (areas 27, 28).

The essence of the present invention shall finally be summarized once again as follows on the basis of the state of the art according to DE 43 29 706 A1, DE 38 00 843 A1 and DE 196 43 023 A1.

In DE 38 00 843, FIG. 1, separating air enters the area of ring disks 12, 13 and 14 of the separator wheel 11 via an inlet 3 from the outside, entraining with it a mixture of fines and coarse material, which is charged in at 6, and a stratification of the originally homogeneous mixture of separating air and fines takes place in that area over a relatively short section. After leaving the area of the ring disks, the parts of the mixture of fines and separating air, which were stratified before, are united again in order to be removed from the separator as a mixture that is again homogeneous. Arriving from the charge hopper 6 and crossing the separating air, coarse material is removed in the downward direction still before the separator wheel 11. Consequently, stratification of the mixture of fines and separating air takes place over the short section of the ring disks 12, 13, 14 alone. A special multistep stratification of the coarse material does not take place in the separation space.

No stratification of separating air and material to be separated takes place in DE 196 43 023. The residence time of the material to be separated, which is charged in above the scattering disk 7 of the separator wheel 3 through an opening surrounding the drive shaft 1, is rather prolonged in the separation space 6, which is crossed by the separating air charged in at 4 in the direction of the diameter of the separator wheel 3, in order to better separate from each other coarse material, on the one hand, and fines and separating air, on the other hand, before the entry of the mixture of separating air and fines into the separator wheel. The residence time of the mixture of material to be separated and separating air in the separation space 6 is prolonged by guiding the material to be separated on a circular arc-shaped path in the separation space by means of a turn of a helix. A special stratification does not take place in the separator wheel.

A comparable helical guiding of material to be separated in the separation space is already achieved in DE 43 29 706 A1, and this guiding is forced to take place by the inlet 3 for the material to be separated and the inlet 5 for the separating air, on the one hand, and the outlet 8 for coarse material as well as the outlet 7 for fines, on the other hand, being arranged offset in relation to one another in the longitudinal direction and the circumferential direction of the cylindrical separator housing 1.

Figure 4:
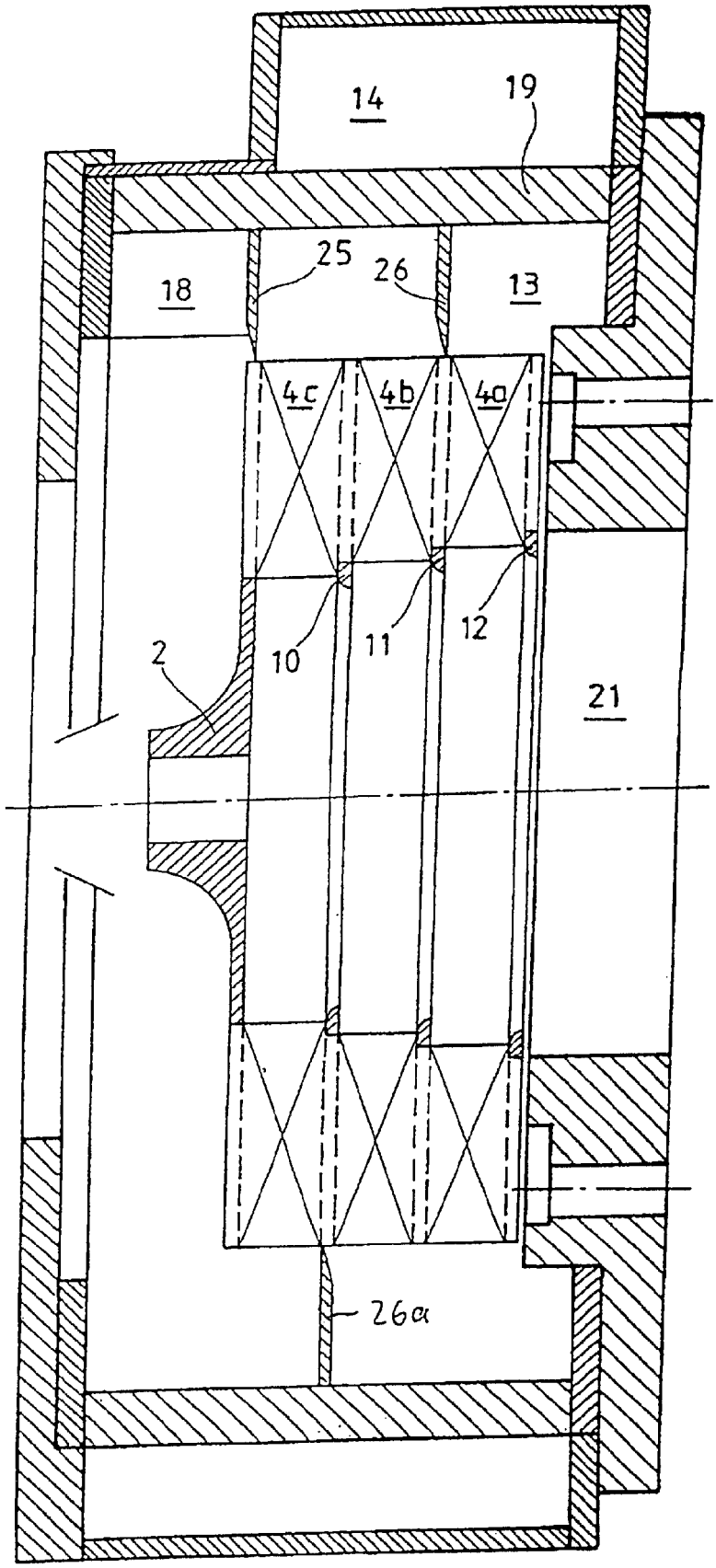
FIG. 4 shows an air separator according to the present invention as a section along line IV—IV in FIG. 2.

Contrary to this, stratification of the material to be separated takes place in the air separator according to the present invention in such a way that (especially in FIG. 4), the material to be separated is charged in at 13 and is guided up to the end of a first circular arc-shaped separation chamber part, which is formed by the circular arc-shaped diaphragm 26, in order to pass over at the end of this separation chamber part into a second circular arc-shaped separation chamber part, which adjoins the first separation chamber part and whose beginning is characterized by the beginning of the second circular arc-shaped diaphragm 26*a,* which follows the first diaphragm 26 offset in the circumferential and longitudinal directions. Finally, the material to be separated enters a third circular arc-shaped separation chamber part, which follows the second circular arc-shaped separation chamber part and whose beginning is characterized by the beginning of the third circular arc-shaped diaphragm 25. Each circular arc-shaped separation chamber part is exactly separated from the respective other separation chamber part except from the respective transition from one separation chamber part into the other, and separation between fines and coarse material takes place in each separation chamber part, and coarse material enters the next separation chamber part from each separation chamber part, and it finally reaches the coarse material outlet 18, while fines will finally correspondingly enter the fines outlet 21; consequently, optimal separation takes place, on the whole, between fines and coarse material. Important is here the avoidance of "short-circuit flows" and the forcing of the mixture of material to be separated and separating air to flow through the separation chamber parts over their entire length, which is due to the specific cooperation of ring disks 8*a*, 8*b*, 8*c* of the separator wheel and of diaphragms 25, 26, 26*a,* which can be recognized especially in FIG. 4; without this cooperation, a "short-circuit flow" would take place, e.g., in the area in which it is prevented in the present invention by the cooperation of the diaphragm 24 and the separator wheel.

What is claimed is:

1. Air separator for separating material to be separated, which is suspended in a gas flow, into coarse material and fines, using a separator wheel, comprising blades in the area of an outer circumference and rotating in a separation space, and blade channels through which gas with fines suspended in it flows radially from the outside, while the coarse material is deflected before it reaches the inner ends of the blade channels, wherein the flow of fines both through the blade channels and, after leaving the blade channels, into the area of an outlet from the separation space is guided by force in a plurality of layers following each other in the direction of the said axis of rotation of the said separator wheel, said separator wheel rotates in a separation space, which is enclosed by a separator housing, which is a helical housing in the view parallel to the said axis of rotation of the separator wheel, with which an inlet for material to be separated and an inlet for separating gas are associated in a diameter plane, while an outlet for coarse material is associated with the separator housing in another diameter plane opposite the two inlets, wherein said two diameter planes are offset in relation to one another in the direction of the axis of rotation of the separator wheel, and the separation space is divided by diaphragms, which are circular arc-shaped in a view in the direction of the separator wheel, into a plurality of sections, which are located one behind another in the direction of flow and by which the material is separated in a stepwise manner into a fines component to be sent to said fines outlet and a coarse material component to be sent to said coarse material outlet.

2. Air separator in accordance with claim 1, wherein the flow of fines both through the blade channels of the separator wheel and up to the area of the outlet from the separation space after leaving said blade channels is guided by force in a plurality of consecutive layers following each other in the direction of said axis of rotation of said separator wheel.

3. Air separator in accordance with claim 2, wherein a stratification of the flow of fines is directed at an angle of 90 degrees in relation to the direction of the blade channels after leaving the blade channels.

4. Air separator in accordance with claim 2 wherein said separator wheel comprises a plurality of disks, and in which a stratification of the flow of fines within the blade channels is brought about by the height of the blades being divided by said disks, while the stratification is brought about after leaving the blade channels by the fact that diameters at inner edges of the blades decrease from a suction opening or from the fines outlet toward a hub in a stepwise manner.

5. Air separator in accordance with claim 1 comprising circular arc-shaped diaphragms aligned with said disks of the separator wheel, arranged in a stepped pattern.

6. Air separator in accordance with claim 1 wherein said circular arc-shaped diaphragms form an angle of at least 180 degrees and the circular arc-shaped diaphragms overlap each other at both ends in the circumferential direction.

* * * * *